US006566796B2

(12) United States Patent
Kodama et al.

(10) Patent No.: US 6,566,796 B2
(45) Date of Patent: May 20, 2003

(54) STEEL SHEET FOR TENSION MASK, MAKING METHOD THEREOF AND TENSION MASK

(75) Inventors: Satoshi Kodama, Fukuyama (JP); Reiko Sugihara, Fukuyama (JP); Hideki Matsuoka, Kasaoka (JP); Yasushi Tanaka, Fukuyama (JP); Tatsuhiko Hiratani, Fukuyama (JP); Kenji Tahara, Fukuyama (JP); Kenichi Mitsuzuka, Fukuyama (JP); Kenichiro Takayanagi, Zama (JP); Masamichi Okada, Atsugi (JP); Hiroaki Kato, Chigasaki (JP); Chohachi Sato, Isehara (JP)

(73) Assignees: NKK Corporation, Tokyo (JP); Sony Corporation, Tokyo (JP)

( * ) Notice: Subject to any disclaimer, the term of this patent is extended or adjusted under 35 U.S.C. 154(b) by 0 days.

(21) Appl. No.: 09/929,850

(22) Filed: Aug. 14, 2001

(65) Prior Publication Data

US 2002/0070653 A1 Jun. 13, 2002

Related U.S. Application Data

(63) Continuation of application No. PCT/JP00/08984, filed on Dec. 19, 2000.

(30) Foreign Application Priority Data

Dec. 20, 1999 (JP) ..... 11-360697

(51) Int. Cl.[7] ..... H01J 29/07; C22C 38/04

(52) U.S. Cl. ..... 313/402; 148/320; 148/306

(58) Field of Search ..... 313/402, 403; 148/310, 336, 306, 320; 420/94, 120, 128

(56) References Cited

U.S. PATENT DOCUMENTS 6,229,255 B1 * 5/2001 Kim et al. ..... 313/402

FOREIGN PATENT DOCUMENTS

| | | |
|---|---|---|
| GB | 2 334 140 A | 8/1999 |
| JP | 62-249339 A | 10/1987 |
| JP | 63-145744 A | 6/1988 |
| JP | 05-311327 A | 11/1993 |
| JP | 05-311330 A | 11/1993 |
| JP | 05-311331 A | 11/1993 |
| JP | 05-311332 A | 11/1993 |
| JP | 06-073503 A | 3/1994 |
| JP | 08-027541 A | 1/1996 |
| JP | 08-269569 A | 10/1996 |
| JP | 09-227998 A | 9/1997 |
| JP | 09-256061 A | 9/1997 |
| JP | 09-296255 A | 11/1997 |
| JP | 10-219396 A | 8/1998 |
| JP | 10-219401 A | 8/1998 |

* cited by examiner

*Primary Examiner*—Michael H. Day
(74) *Attorney, Agent, or Firm*—Frishauf, Holtz, Goodman & Chick, P.C.

(57) ABSTRACT

A method of making a steel sheet for a tension mask, including the steps of: hot rolling a steel consisting essentially of, by weight %, C: less than 0.1%, Si: 0.05% or less, Mn: 0.4 to 2%, P: 0.03% or less, S: 0.03% or less, sol.Al: 0.01% or less, N: 0.010% or more, and the balance of Fe; and annealing the cold rolled steel sheet, followed by a secondary cold rolling at a reduction rate of 35% or higher. The steel sheet produced by this method shows excellent creep resistance during blackening treatment and excellent magnetic shielding property with an anhysteretic permeability of 3400 or more at a DC bias magnetic field of 0.35 Oe, and therefore causes no color-deviation when applied to the tension mask.

20 Claims, 1 Drawing Sheet

STEEL SHEET FOR TENSION MASK, MAKING METHOD THEREOF AND TENSION MASK

This application is a continuation application of International Application PCT/JP00/08984 (not published in English) filed Dec. 19, 2000.

BACKGROUND OF THE INVENTION

1. Field of the Invention

The present invention relates to a steel sheet for a tension mask incorporated in color cathode ray tubes of televisions or computers, a making method thereof, and a tension mask using the same.

2. Description of Related Arts

Some color cathode ray tubes of televisions or computers incorporate a color selection electrode loaded with large tension like an aperture grill as a color selection mechanism, so-called a tension mask.

The tension mask is in general produced by subjecting a low carbon steel or an ultra low carbon Al-killed steel to hot rolling, cold rolling, continuous annealing, secondary cold rolling, and, as needed, to annealing for removing residual stress, followed by making apertures by photo-etching process, attaching to a frame by loading a tension of 200 to 400 N/mm$^2$, for example, in one direction or two directions, and performing blackening treatment.

The blackening treatment is a heat treatment heating to temperatures of, e.g., 450 to 500° C. so as to form an oxide film of magnetite on the steel surface, aiming at prevention of rusts on the tension mask or reduction of heat radiation, and at this time the tension of the mask sometimes lowers due to creep phenomenon of the steel sheet used to the tension mask. When the tension goes down, an aperture position of the mask may shift, the mask becomes easy to be resonated by speaker sound, and an electron beam does not land on a designated position, resulting in so-called "color-deviation".

For preventing the creep phenomenon, JP-A-62-249339, (the term "JP-A" referred to herein signifies "Unexamined Japanese Patent Publication"), JP-A-5-311327, JP-A-5-311330, JP-A-5-311331, JP-A-5-311332, JP-A-6-73503, JP-A-8-27541, JP-A-9-296255, and JP-A-11-222628 disclose methods of adding elements such as Mn, Cr, Mo to steels for tension masks, or making much N solute in steel sheets for restraining climb motion of dislocation.

Further, recently accompanied with cathode ray tubes becoming large scaled, highly defined and flat, other than "color-deviation" caused by creep phenomenon of steel sheets, there has appeared a problem as "color-deviation" also caused by discrepancy in orbits of electron beams due to external magnetic field such as the earth magnetism.

For preventing "color-deviation" by the external magnetic field, it is effective to improve the magnetic shielding property of tension masks, and as methods therefore, JP-A-63-145744, JP-A-8-269569 and JP-A-9-256061 show methods of adding Si to steels for tension masks, JP-A-10-219396 shows Cu addition, and JP-A-10-219401 discloses Ni addition.

However, any investigations have not been made on the magnetic shielding property against external magnetic field in JP-A-62-249339, JP-A-5-311327, JP-A-5-311330, JP-A-5-311331, JP-A-5-311332, JP-A-6-73503, JP-A-8-27541, JP-A-9-296255, and JP-A-11-222628.

In particular, the methods described in JP-A-63-145744, JP-A-8-269569, JP-A-9-256061 and JP-A-10-219396 improve the magnetic shielding property, but because of containing Si and Cu, surface defects easily appear on the steel sheet at hot-rolling or recrystallization annealing, and therefore these methods are unwelcome in the application to tension masks requiring severe surface property.

The method of JP-A-10-219401 invites cost-up of steel sheets and deteriorates etching property due to the Ni addition.

SUMMARY OF THE INVENTION

The object of the present invention is to provide a steel sheet for a tension mask having excellent creep resistance and magnetic shielding property without deteriorating surface property or etching property, a method of making the same, and a tension mask using such a steel sheet.

The object of the present invention can be accomplished by a method of making a steel sheet for a tension mask, comprising the steps of: hot rolling a steel consisting essentially of, by weight %, C: less than 0.1%, Si: 0.05% or less, Mn: 0.4 to 2%, P: 0.03% or less, S: 0.03% or less, sol.Al: 0.01% or less, N: 0.010% or more, and the balance of Fe; cold rolling the hot rolled steel sheet; and annealing the cold rolled steel sheet, followed by a secondary cold rolling at a reduction rate of 35% or higher.

DETAILED DESCRIPTION OF THE INVENTION

Figure 1:
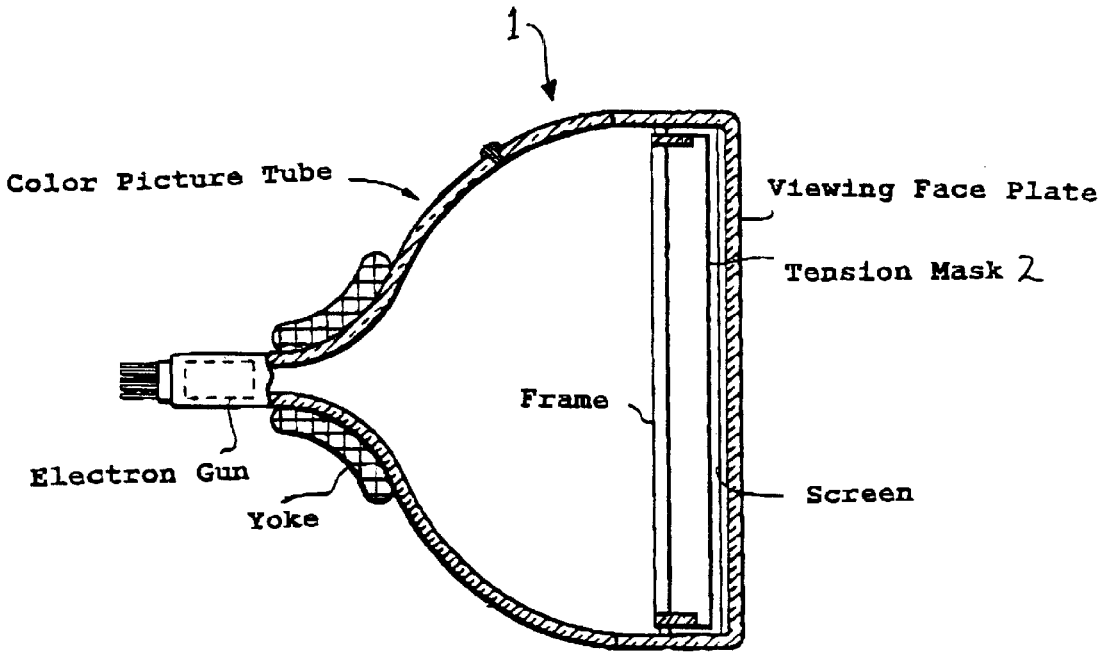
FIG. 1 is a side sectional view illustrating a color picture tube which includes a tension mask.

In general, the magnetic shielding property of steel sheet is evaluated with the permeability thereof, and if decreasing the content of elements in steel such as Mn, Mo, Cr and N, the permeability becomes high, and the magnetic shielding property goes up. However, if decreasing the content of these elements, the creep resistance is deteriorated. Thus, the improvement of permeability and that of creep resistance tend to be contradictory each other.

As shown in FIG. 1, a cathode ray tube 1 is equipped with a mechanism which supplies current to a demagnetizing coil when turning on an electric source for demagnetizing materials of the tube such as a tension mask 2. Since this demagnetization is carried out in an external magnetic field, for example, in the earth magnetism, the tension mask is not completely demagnetized but has a residual magnetization. Therefore, for evaluating the magnetic shielding property of the tension mask, an anhysteretic permeability dividing the residual magnetization by the external magnetic field is more preferable than the usual permeability. The higher the anhysteretic permeability, the easier the magnetic flux of external magnetic field, e.g., the earth magnetism passes through the tension mask, and the excellent magnetic shielding property may be obtained.

As to a steel sheet for a tension mask, we made studies on the relationship between creep phenomenon during the blackening treatment, anhysteretic permeability and color-deviation. As a result, the following findings are obtained.

① If the anhysteretic permeability at a DC bias magnetic field of 0.35 Oe is 3400 or more after blackening treatment, the excellent magnetic shielding property is available, and the color-deviation may be suppressed from a practical view point.

② If Mn of 0.4% or more and N of 0.010% or more are added, and the reduction rate of secondary cold rolling after annealing is 35% or higher, the excellent creep resistance is obtained, and the anhysteretic permeability may be 3400 or more.

③ Adding N of 0.012% or more, and adding Mo in a range of 0.3% or lower, the creep resistance is further improved.

The present invention is based on the above findings. The detailed explanation will be made as follows.

1) Chemical composition

C: This is an element for improving the creeping resistance together with Mn and Mo. An addition of 0.1% or more precipitates coarse cementites, and deteriorates the etching property. Accordingly, the content of C is set to be less than 0.1%, preferably 0.06% or less, and more preferably 0.03% or less.

Si: This element forms non-metallic inclusions, and deteriorates the etching property. Accordingly, the content of Si is set to be 0.05% or less, preferably 0.03% or less.

Mn: This is an important element for improving the creep resistance. For providing an excellent creep resistance during the blackening treatment, the content of Mn is set to be 0.4% or more, preferably exceeding 0.6%, but although adding more than 2%, an effect thereby is saturated and a cost-up is invited. Thus, the content of Mn is set to be 2% or lower.

P: This is an element causing irregularity in etching, resulting from segregation, and so the content of P is set to be 0.03% or less, preferably 0.02% or less.

S: This is an element unavoidably included in steel. Being more than 0.03%, it causes hot brittleness and generates etching irregularity. The content of S is therefore set to be 0.03% or less, preferably 0.02% or less.

sol.Al: This is an element which stabilizes solute N as AlN and decreases the said solute N being effective for improving the creep resistance which will be referred to next. Thus, the lesser the better, and the content of sol.Al should be 0.01% or less.

N: Making this element solute in steel, it improves the creep resistance. For obtaining an excellent creep resistance during the blackening treatment, its content is necessarily set to be 0.01% or more. Being 0.012% or more, the creep elongation is markedly decreased.

The balance other than the above mentioned composition is substantially Fe.

In addition to the above composition, if Mo is added in a range of 0.3% or less, a more excellent creep resistance may be obtained. Mo of more than 0.3% spoils the etching property.

2) Making method

The steel consisting essentially of the above composition in the range of the invention passes, following an ordinary procedure, through smelting-casting-hot rolling-pickling-cold rolling (primary)-recrystallization annealing.

Subsequently, if performing secondary cold rolling at a reduction of 35% or more on the above annealed steel sheet, the anhysteretic permeability at a DC bias magnetic field of 0.35 Oe is 3400 or more after the blackening treatment, and therefore the excellent magnetic shielding property may be obtained. This mechanism is not completely cleared, but it may be considered that if the secondary reduction is 35% or higher, a recovery of the steel sheet easily progresses during the blackening treatment, so that the magnetic property is improved.

If the reduction rate is considerably increased, not only the anhysteretic permeability is saturated, but also a load of rolling mill increases, and therefore its upper limit is preferably 80%, and the secondary reduction rate is preferably 40 to 70%, taking the rolling mill load and the magnetic property into consideration.

In case there occurs a problem about twist of the grill called as "line disturbance" in the aperture grill, it is preferable to anneal the steel sheet at a temperature range of 450 to 600° C. after the secondary cold rolling for removing residual stress existing in the steel sheet.

The tension mask made of the steel sheet produced by the method of the present invention has excellent creep resistance and magnetic shielding property, and so this can be sufficient in response to the enlargement, the higher definition and the flattening of the cathode ray tubes.

EXAMPLE

The steels A to I in Table 1 were smelted, followed by hot rolling, ground on the surface so as to adjust the sheet thickness, and cold rolled at a reduction rate of 91.3% to reduce the thickness to 0.14 to 0.5 mm. After the recrystallization annealing, the secondary cold rolling was carried out at a reduction rate of 30 to 80%, and sample Nos. 1 to 21 of the thickness being 0.1 mm were produced.

TABLE 1

| Steel | C | Si | Mn | P | S | sol.Al | N | Mo | Remark |
|---|---|---|---|---|---|---|---|---|---|
| A | 0.0046 | 0.02 | 0.45 | 0.015 | 0.006 | 0.005 | 0.0126 | — | Example steel |
| B | 0.0074 | 0.02 | 0.40 | 0.037 | 0.004 | 0.005 | 0.0133 | — | Comparative steel |
| C | 0.0081 | 0.02 | 0.62 | 0.008 | 0.010 | 0.003 | 0.0120 | — | Example steel |
| D | 0.0071 | 0.02 | 0.59 | 0.007 | 0.003 | 0.008 | 0.0074 | — | Comparative steel |
| E | 0.0073 | 0.02 | 1.04 | 0.015 | 0.005 | 0.005 | 0.0148 | — | Example steel |
| F | 0.018 | 0.01 | 0.61 | 0.005 | 0.007 | 0.008 | 0.0108 | — | Example steel |
| G | 0.150 | 0.01 | 0.60 | 0.007 | 0.005 | 0.008 | 0.0125 | — | Comparative steel |
| H | 0.0052 | 0.02 | 0.42 | 0.004 | 0.035 | 0.005 | 0.0123 | 0.1 | Comparative steel |
| I | 0.0057 | 0.02 | 0.61 | 0.015 | 0.005 | 0.005 | 0.0124 | 0.3 | Example steel |

Unit: weight %

The samples were subjected to the evaluation of etching property, creep resistance, and magnetic property through the following manners.

As to the etching property, the aperture grill was subjected to the actual etching like a blind screen for visual evaluation of defects. ○ denoted the case when no defect was present, and × denoted the case when any defect was present.

As to the samples of the good evaluation in the etching property, the creep resistance and the magnetic property were evaluated.

As to the creep resistance, the samples were held at 450° C. for 20 minutes under a condition of loading tension of 300 $N/mm^2$, and ◎ denoted the especially good case of the creep elongation being 0.40% or less, ○ denoted the case when the creep elongation being above 0.40% but below 0.60%, and × denoted the case of the creep elongation exceeding 0.60%, as not durable case to use. By the way, the creep elongation was an average value in the rolling direction and in the right angled direction to the rolling.

or Mo was added, the creep resistance was good. If the secondary reduction rate was 35% or more, the anhysteretic permeability was above 3400.

On the other hand, in the comparative examples Nos. 2, 3, 9 to 12, 17 and 18, one or more of the etching property, the creep resistance and the magnetic property were inferior.

TABLE 2

| Sample No. | Steel | Secondary reduction rate (%) | Etching property | Creep resistance Elongation % | Creep resistance Evaluation | Magnetic property μ 0.35 | Magnetic property Br(G) | Magnetic property Hc(Oe) | Anhysteretic permeability | Remarks |
|---|---|---|---|---|---|---|---|---|---|---|
| 1 | A | 50 | ○ | 0.53 | ○ | 170 | 10400 | 6.2 | 4250 | E |
| 2 | B | 60 | x | — | — | — | — | — | — | C |
| 3 | C | 30 | ○ | 0.47 | ○ | 170 | 8200 | 6.7 | 3380 | C |
| 4 | C | 35 | ○ | 0.48 | ○ | 170 | 9000 | 6.7 | 3720 | E |
| 5 | C | 40 | ○ | 0.50 | ○ | 170 | 9700 | 6.7 | 4000 | E |
| 6 | C | 60 | ○ | 0.58 | ○ | 170 | 10700 | 6.7 | 4380 | E |
| 7 | C | 70 | ○ | 0.58 | ○ | 170 | 10700 | 6.7 | 4400 | E |
| 8 | C | 80 | ○ | 0.60 | ○ | 170 | 10700 | 6.7 | 4400 | E |
| 9 | D | 35 | ○ | 0.63 | x | 175 | 9300 | 6.7 | 4100 | C |
| 10 | D | 50 | ○ | 0.65 | x | 175 | 10800 | 6.7 | 4760 | C |
| 11 | D | 60 | ○ | 0.76 | x | 175 | 11000 | 6.7 | 4840 | C |
| 12 | E | 30 | ○ | 0.27 | ◎ | 165 | 8100 | 7.6 | 3160 | C |
| 13 | E | 35 | ○ | 0.28 | ◎ | 165 | 8900 | 7.6 | 3480 | E |
| 14 | E | 50 | ○ | 0.28 | ◎ | 165 | 10300 | 7.6 | 4030 | E |
| 15 | E | 70 | ○ | 0.33 | ◎ | 165 | 10500 | 7.6 | 4120 | E |
| 16 | F | 60 | ○ | 0.52 | ○ | 170 | 10700 | 7.0 | 4500 | E |
| 17 | G | 50 | x | — | — | — | — | — | — | C |
| 18 | H | 60 | x | — | — | — | — | — | — | C |
| 19 | I | 35 | ○ | 0.37 | ◎ | 170 | 9000 | 6.6 | 3680 | E |
| 20 | I | 50 | ○ | 0.39 | ◎ | 170 | 10400 | 6.6 | 4270 | E |
| 21 | I | 60 | ○ | 0.45 | ○ | 170 | 10600 | 6.6 | 4340 | E |

E: Example
C: Comparative example

As to the magnetic property, the samples were subjected to the heating treatment at 450° C. for 20 minutes corresponding to the blackening treatment, and from these treated samples, taken out were ring test pieces of the outer diameter being 45 mm and the inner diameter being 33 mm, on which a magnetizing coil, a search coils, and a DC-bias-field coil were set for measuring the permeability ($\mu$0.35) at 0.35 Oe, the residual magnetic flux (Br) at the maximum magnetizing field being 50 Oe, the coercive force (Hc), and the anhysteretic permeability. The anhysteretic permeability was measured in the following way.

① The damping AD current was supplied to the magnetizing coil to completely demagnetize the test pieces.

② The DC current was supplied to the DC-bias-field coil to generate the DC bias magnetic field being 0.35 Oe, and under this condition, the damping AD current was again supplied to the magnetizing coil to demagnetize the test pieces.

③ The DC current was supplied to the magnetizing coil to magnetize the test pieces, and the generated magnetic flux was detected by the search coil for measuring B—H curve.

④ The anhysteretic permeability was calculated from the B—H curve.

The results are shown in Table 2.

In the examples Nos. 1, 4 to 8, 13 to 16 and 19 to 21, the etching property and the creep resistance were good, and the anhysteretic permeability was 3400 or more and the magnetic shielding property was excellent. In particular, as to the creep elongation, in case N was 0.010% or more, it went down to 0.60% or less, and in case N was 0.012% or more,

What is claimed is:

1. A method of making a steel sheet for a tension mask, comprising the steps of:

hot rolling a steel consisting essentially of, by weight %, C: less than 0.1%, Si: 0.05% or less, Mn: 0.4 to 2%, P: 0.03% or less, S: 0.03% or less, sol.Al: 0.01% or less, N: 0.010% or more, and the balance of Fe;

cold rolling the hot rolled steel sheet; and annealing the cold rolled steel sheet, followed by a secondary cold rolling at a reduction rate of 35% or higher.

2. The method as set forth in claim 1, wherein the content of N is 0.012% or more.

3. A steel sheet for a tension mask produced by the method as set forth in claim 2.

4. In a tension mask comprising a steel sheet, the improvement comprising the steel sheet being the steel sheet as set forth in claim 3.

5. A steel sheet for a tension mask produced by the method as set forth in claim 1.

6. In a tension mask comprising a steel sheet, the improvement comprising the steel sheet being the steel sheet as set forth in claim 5.

7. A method as set forth in claim 1, wherein the C is 0.06 weight % or less, the Si is 0.03 weight % or less, the Mn is 0.6 to 2 weight %, the P is 0.02 weight % or less, the S is 0.02 weight % or less and the N is 0.012 weight % or more.

8. A method as set forth in claim 1, wherein the C is 0.03 weight % or less.

9. A method as set forth in claim 1, wherein the secondary cold rolling is carried out at a reduction rate of 40 to 70%.

10. A method as set forth in claim 9, wherein the annealing is carried out at a temperature of 450 to 600° C.

11. A method of making a steel sheet for a tension mask, comprising the steps of:

hot rolling a steel consisting essentially of, by weight %, C: less than 0.1%, Si: 0.05% or less, Mn: 0.4 to 2%, P: 0.03% or less, S: 0.03% or less, sol.Al: 0.01% or less, N: 0.010% or more, Mo: 0.3% or less, and the balance of Fe;

cold rolling the hot rolled steel sheet; and annealing the cold rolled steel sheet, followed by a secondary cold rolling at a reduction rate of 35% or higher.

12. The method as set forth in claim 11, wherein the content of N is 0.012% or more.

13. A steel sheet for a tension mask produced by the method as set forth in claim 12.

14. In a tension mask comprising a steel sheet, the improvement comprising the steel sheet being the steel sheet as set forth in claim 13.

15. A steel sheet for a tension mask produced by the method as set forth in claim 11.

16. In a tension mask comprising a steel sheet, the improvement comprising the steel sheet being the steel sheet as set forth in claim 15.

17. A method as set forth in claim 11, wherein the C is 0.06 weight % or less, the Si is 0.03 weight % or less, the Mn is 0.6 to 2 weight %, the P is 0.02 weight % or less, the S is 0.02 weight % or less and the N is 0.012 weight % or more.

18. A method as set forth in claim 11, wherein the C is 0.03 weight % or less.

19. A method as set forth in claim 11, wherein the secondary cold rolling is carried out at a reduction rate of 40 to 70%.

20. A method as set forth in claim 19, wherein the annealing is carried out at a temperature of 450 to 600° C.

* * * * *